US005860781A

United States Patent [19]

Wiedemer

[11] Patent Number: 5,860,781

[45] Date of Patent: Jan. 19, 1999

[54] DOCUMENT PRINTING APPARATUS AND METHOD

[75] Inventor: Manfred Wiedemer, Ismaning, Germany

[73] Assignee: Océ Printing Systems GmbH, Poing, Germany

[21] Appl. No.: 676,388

[22] PCT Filed: Jan. 16, 1996

[86] PCT No.: PCT/DE95/00043

§ 371 Date: Jul. 24, 1996

§ 102(e) Date: Jul. 24, 1995

[87] PCT Pub. No.: WO95/20185

PCT Pub. Date: Jul. 27, 1995

[30] Foreign Application Priority Data

Jan. 24, 1994 [DE] Germany ..... 44 01 907.6

[51] Int. Cl.[6] ..... B42C 13/00

[52] U.S. Cl. ..... 412/9; 412/1

[58] Field of Search ..... 412/9, 11, 16, 412/12, 14, 18, 19, 20, 33, 35, 37; 281/29, 36, 37, 21.1; 29/712, 714, 720; 271/291; 355/407

[56] References Cited

U.S. PATENT DOCUMENTS

| | | | |
|---|---|---|---|
| 4,522,542 | 6/1985 | Minor | 412/14 X |
| 4,875,611 | 10/1989 | Poehlein et al. . | |
| 4,891,681 | 1/1990 | Fiske et al. . | |
| 5,166,736 | 11/1992 | Ogawa et al. . | |
| 5,417,535 | 5/1995 | Andjelic et al. | 412/16 X |
| 5,601,389 | 2/1997 | Minami | 412/14 |
| 5,735,659 | 4/1998 | Kosasa et al. | 412/16 X |

FOREIGN PATENT DOCUMENTS

| | | |
|---|---|---|
| 0 485 786 | 5/1992 | European Pat. Off. . |
| 0 553 870 | 8/1993 | European Pat. Off. . |
| 0 611 019 | 8/1994 | European Pat. Off. . |
| 30 01 058 | 11/1980 | Germany . |
| 40 38 307 | 6/1991 | Germany . |
| 41 07 799 | 9/1992 | Germany . |
| 42 13 541 | 10/1992 | Germany . |
| WO 94/27193 | 11/1994 | WIPO . |

OTHER PUBLICATIONS

IBM Technical Disclosure Bulletin, "Two–Path Electrophotographic Print Process", K. Sanders, vol. 22, No. 6, Nov. 1979, pp. 2465–2466.

Druck print Feb. 1982, Die Führung endloser Bahnen durch Rotationsdruckmaschinen, pp. 96–100.

DE–Fachbuch von A. Braun, Der Tiefdruck, seine Verfahren und Maschinen, 1952, Polygraph verlag GmbH, Frankfurt, pp. 216–225.

*Primary Examiner*—Willmon Fridie, Jr.
*Attorney, Agent, or Firm*—Hill & Simpson

[57] ABSTRACT

A document printing appliance with a paper feed device (E1, E2) processing strip-like recording media (A) of preselectable configuration and having a downstream electrographic printing device (DRU) which can print the strip-like recording media (A) on one side and on both sides, and with a paper post-processing device coupled to the electrographic printing device (DRU) on the output side. Said paper post-processing device has a print-page separating device (V), a buffer store (ZS) for the job-related reception of the separated print pages, and a job finishing device (JF) coupled to the buffer store, for the document-related compilation of print pages extracted from the buffer store (ZS).

17 Claims, 7 Drawing Sheets

DOCUMENT PRINTING APPARATUS AND METHOD

BACKGROUND OF THE INVENTION

1. Field of the Invention

The present invention relates to an apparatus and method for producing documents composed of single sheets by means of an electrographic printing device which prints strip-like recording media.

2. Description of the Related Art

Documents, such as brochures, insurance certificates, etc., which are produced by means of electrographic, magnetographic or other non-impact printing devices, are preferably compiled from single sheets of differently colored or differently preprinted papers or of different basis weights (for example, paper weights).

Single-sheet printers having various (for example, 4) input compartments are employed for these instances of use. The documents can therefore be printed in the correct sequence by an appropriate choice of the input compartments.

Single-sheet printers necessitate an increased technical outlay for paper handling and printing. Moreover, the transport of single sheets is susceptible to faults. Furthermore, only paper weights and formats within a narrow range can be used.

Although it is known to couple electrographic printers for processing continuous paper to a separating device (such as a cutting device) and thereby to separate the printed-on print pages according to jobs, nevertheless only one format or one specific paper weight can ever be used in this case. Furthermore, in general, the increasing sequence during the printing operation with continuous paper is difficult to verify. Different paper weights and formats must subsequently be additionally fed into the printer in a separate work process.

European Patent Document EP-A1-0,553,870 discloses a document printing appliance which contains, as a central printing unit, an electrographic single-sheet printing device capable of operating in simplex and duplex mode. The single-sheet printing device is preceded by a paper feed device having an integrated cutting device, via which web paper is cut to format and fed to the printing unit. For the separate feed of precut single sheets, the paper feed device can additionally contain a single-sheet feed. In a paper post-processing unit, the printed single sheets are combined to. form a document.

SUMMARY OF THE INVENTION

The object of the invention is to provide a printing device and a method of the type initially mentioned, by means of which documents consisting of single sheets can be produced in a simple and cost-effective way with a high print quality and at a high printing speed.

This and other objects of teh invention are achieved by a document printing appliance with a paper feed device for processing strip-like recording media of preselectable configuration, an electrographic printing device which is coupled to the paper feed device on the input side and which has means for printing the strip-like recording medium or media on one side and/or on both sides, a paper post-processing device coupled to the electrographic printing device on the output side and having an associated print-page separating device, and a buffer store for the job-related reception of the separated print pages in corresponding storage regions and a job finishing device, which is coupled to the buffer store and which extracts from the storage regions of the buffer store in a document-dependent manner the job component of a first paper grade, which, drawn off from a first recording medium web, has been deposited in a corresponding storage region of the buffer store, and the job component of a second paper grade, which, drawn off from a second recording medium web, has been deposited in a corresponding storage region of the buffer store, and which combines them to form a document, and a job organization control unit for controlling the components of the document printing apparatus in dependence on an enterable document makeup.

A further development of the document printing appliance is provided wherein the job organization control unit has input means for the input of the document makeup, and a selection control coupled to the input means and components of the document printing apparatus, in order, depending on the entered document makeup, to print the strip-like recording media via the printing device in a configuration-related manner, separate them in the separating device, deposit them in the buffer store and combine them in the job finishing device according to the desired document makeup to form a document.

Preferably, a job sequence control is provided coupled in a functionally dependent manner to components of the document printing apparatus and having means for recording the print pages processed in the printer and the separated sheets deposited in the buffer store, and with a comparison device which triggers an evaluation signal in dependence on the comparison operation.

The paper feed device is designed to receive different stock rolls and/or stacks of the strip-like recording media. In a preferred embodiment, a separating device which has a cutting device having an associated waste disposal device is provided. The buffer store may have part stores assigned to the individual printing jobs. Also, a binding and/or stitching device may be is coupled to the job finishing device to compile documents.

The printing device has a friction drive for the strip-like recording medium. The paper feed device which feeds the strip-like recording medium that is configured as web stock and/or as stacking stock to the friction drive preferably has: a web precentering device which aligns the strip-like recording medium by positive guidance along an alignment edge, a device increasing the tensile stress in the strip-like recording medium downstream of the web centering device in the direction of transport of the recording medium such that the strip-like recording medium assumes a predetermined position in the friction drive, a web stabilizing device for stabilizing the run of the recording medium in a stabilizing zone preceding the friction drive, and a mechanical web store for the recording medium web. In one embodiment, the web precentering device has friction rollers which are inclined relative to the direction of transport of the recording medium and which are in frictional contact with the recording medium. In an embodiment, the device increases the tensile stress on the recording medium by having a braking device which uniformly brakes the recording medium web over its width. The web stabilizing device preferably has stabilizing rollers, around which the recording medium is wrapped and which are provided, if required, with a friction-increasing surface. The mechanical web store has a looper.

The document printing apparatus has a single-sheet loading device assigned to the buffer store for the external loading of the buffer store with prefabricated single sheets.

The present invention also provides a method for producing a document composed of single sheets of a first paper grade and a second paper grade, with the following method steps: printing of a first strip-like recording medium assigned to the first paper grade and printing of a second strip-like recording medium assigned to the second paper grade in an electrographic printing device which is suitable for printing the recording media on one side and/or on both sides; separation of the strip-like recording media and paper grade-related depositing of the single sheets thus produced in part stores of a buffer store; and controlled compilation of the job component of the first strip-like recording medium and of the job component of the second strip-like recording medium to form a document.

The present invention combines the technical advantages of an electrographic printing device working with continuous paper, for example in terms of processing speed, print quality and efficiency, with the advantages of a single-sheet machine.

The document printing appliance uses,. as a printing device, an electrographic single-sheet printing device which is suitable for printing continuous paper on one side and on both sides (simplex/duplex). By means of the friction drive for the recording medium, the printing device can process web paper and folded paper (accordion folded paper) with and without marginal perforation and with separating perforations. The change of the paper grade is limited to only a few operations, specifically, for example, depending on the number of paper grades. For example, in a small run of a brochure in printing sequences assigned to paper grades (paper configuration), all the sheets of the same type of paper are printed. The draw sheets to be inserted into the brochure are first buffer-stored electronically and, after the printing of the "normal" or actual information sheets, are printed by changing the type of paper once. Combining the normal sheets with the draw sheets to form the brochure takes place in the printer output station, in which binding or stapling can also subsequently be carried out, as required. The process flow is monitored by adding up the individual sheets and by working through them in the buffer store and thereby guaranteeing its reliable flow. In addition, externally produced single sheets, for example advertising brochures, can also be fed into this collating function via an external input. To make it easier to change the paper configuration, the paper feed can have externally arranged paper stock rolls of differing size and paper quality. The change can be carried out by hand or automatically via the printer control.

BRIEF DESCRIPTION OF THE DRAWINGS

An embodiment of the invention is represented in the drawings and is described in more detail below by way of example. In the drawings.

DETAILED DESCRIPTION OF THE PREFERRED EMBODIMENTS

Figure 1:
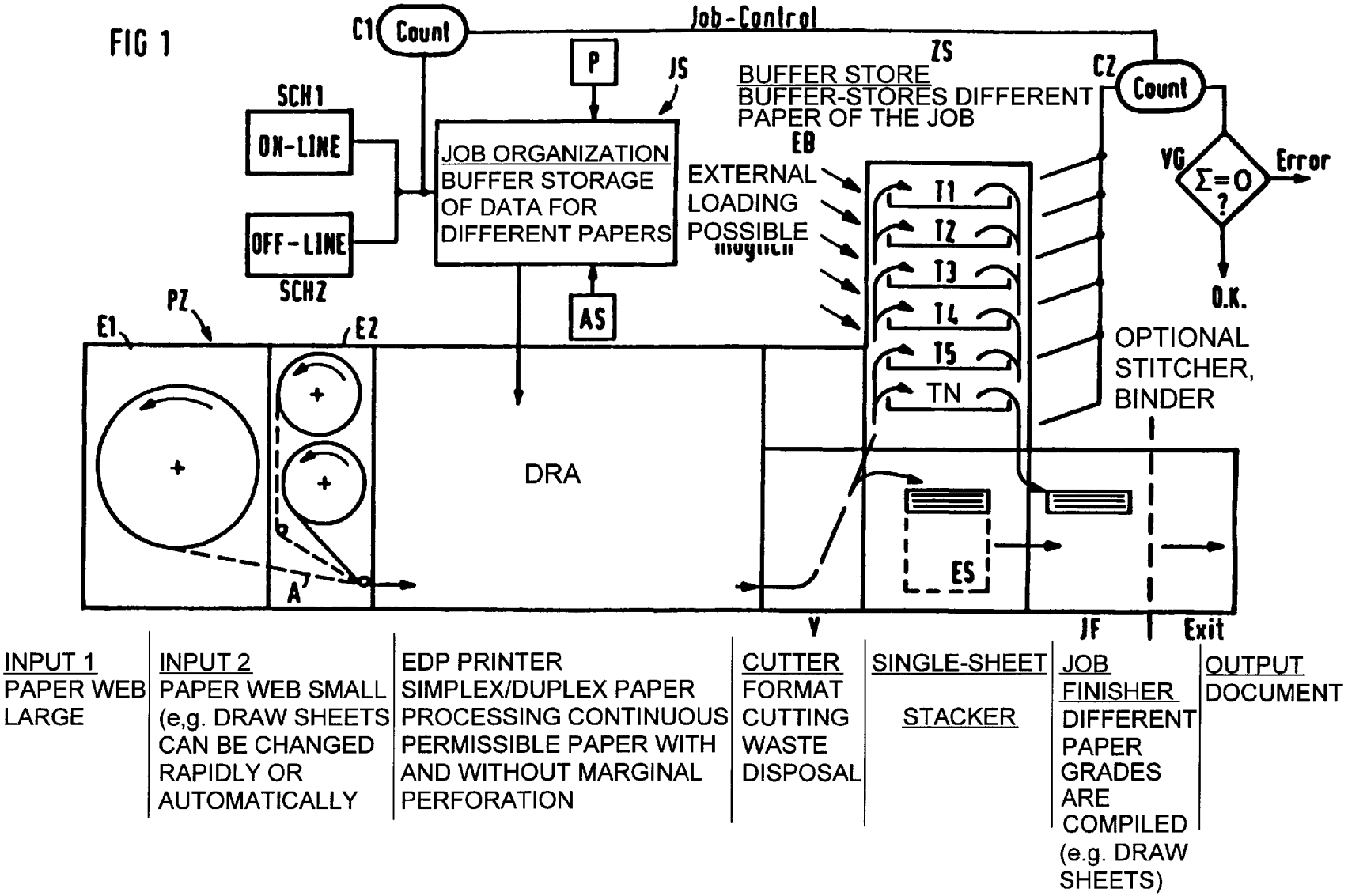
FIG. 1 shows a diagrammatic representation of a document printing device with an electrographic printing device.

The document printing appliance represented in FIG. 1 combines the efficiency of a continuous printing. device with the efficiency of a single-sheet printing device. It consists essentially of a paper feed device PZ with two input regions E1 and E2. In the exemplary embodiment represented in FIG. 1, web paper is used in both input regions, but, according to the exemplary embodiment of FIG. 2, web paper and prefolded continuous paper can also be used. The input part El contains a large paper reel, typically of white paper, that is to say a recording medium, of which the plurality of print pages consists. Located in the input compartment E2 are the recording media rolled up on two reels, for example for draw sheets, that is to say of a paper grade which is used to a lesser extent. Four reels can also be arranged in the input compartment E2, for example when a recording medium having a recording medium width corresponding to the examples of FIGS. 3, 4 and 5 is employed. In this case, altogether four reels can be arranged in the input compartment E2, two at the top and two at the bottom. Downstream of the paper feed device PZ is an electrographic printing assembly DRA which can be designed according to the exemplary embodiments of FIGS. 3 to 9 and in which the continuous paper A can be printed on one side or on both sides within the assembly. Coupled to the printing assembly DA on the output side is a paper post-processing device which separates the printed continuous paper and which composes or assembles a document from the separated single sheets. For this purpose, the paper post-processing device contains a print-page separating device V in the form of a cutting device with an associated waste disposal, for example in the form of a container which receives the cut-off parts of the recording medium A. Furthermore, the paper post-processing device contains a buffer store ZS for the job-related reception of the separated print pages which are deposited in part stores T1 to TN that are designed in the form of containers. Furthermore, the buffer store ZS contains a single-sheet stacking device ES which is served when, broadly speaking, only one paper grade is being printed. The buffer store ZS is coupled to a job finishing device JF for the document-related compilation of print pages extracted from the buffer store. Moreover, the job finishing device can also contain a binding or stitching device for stitching or binding the document compiled via the job finishing device. The document which has thus been bound is discharged via an output device (or exit).

The document printing appliance is activated via a job organization control unit JS which can be designed with a microprocessor control. It comprises input means, for example in the form of a panel P, for the input of the document makeup. This input can take place manually, but it can also be controlled via a data connection to a PC or to a desktop publishing device. The job organization control unit JS contains, furthermore, a, for example, microprocessor-controlled selection control unit AS, in order, depending on the document makeup in the printing assembly DRA entered via the input unit P, to print the strip-like recording medium A, separate it and deposit it in the buffer store ZS in a job-related manner, and in order to combine the individual jobs in the job finishing device JF according to the desired document makeup to form a document. The job organization control unit JS can be coupled to an EDP system via interfaces and be operated online (SCH1), or it is connected to an internal, for example desktop publishing unit and is operated in the offline mode (SCH2). Furthermore, the job organization control unit JS is assigned a monitoring arrangement in the form of a job sequence control. This contains an input-side counter C1 and an output-side counter C2 as well as a comparison unit VG coupled to the counters C1 and C2. By means of the counters C1 and C2, the print pages processed in the printing assembly DRA are counted and are compared with those separated sheets deposited in the buffer store ZS. Depending on this comparison operation, an evaluation signal is triggered by the comparison device VG. If the number is different, an error signal (that is here named error) is generated (error). If the number of print pages is identical, no print page has been lost and an OK signal is generated.

Moreover, the buffer store is connected to an external loading device EB, via which, for example, externally preprinted single sheets in the form of advertising brochures or the like can be fed to the individual part stores T1 to TN.

The printing device as a whole functions as follows:

If, for example, a brochure consisting of 30 single sheets with an associated draw sheet is to be printed, the document makeup is entered via the panel P of the job organization control unit. The input can also come via a host or from the disk store or online via the interface SH1 from a coupled EDP system. The job organization control unit JS sorts the printing information in a storage unit, frequently occurring print pages of one paper grade being assigned to one storage region and the less frequent print pages of a different paper grade (for example, draw sheets) being assigned to another storage region. Subsequently, everything of one paper grade is printed in one job and then everything of the other paper grade in a further job. In the instance represented, therefore, continuous paper is first drawn off from the large paper reel of the input device E1 and is printed with the frequently occurring single-sheet print data, and then this job together with the print pages is deposited, for example, in the part container T1 of the buffer store ZS. Thereafter, the printing of the draw sheet takes place in a further job by drawing in the paper grade assigned to the draw sheet out of the input compartment E2, this job then being deposited in the part compartment T2. In practice, the job component corresponding to one paper grade is always completed, and the transition is then made to the job component of the other paper grade. The format cut and the separation before depositing in the buffer store ZS take place in the format cutting device V. Subsequently, the document is compiled in the job finishing device JF under the control of the job organization control unit JS, specifically by collating the jobs in the desired sequence by extraction from the part compartments T1 to TN of the buffer store ZS.

In the exemplary embodiment represented, by means of the paper feed device PZ continuous paper of the desired grade is fed to the printing device DRA automatically or by hand, as required. The continuous paper is printed and separated, and a document is compiled from the separated continuous paper of widely differing paper grades. The single-sheet stacker ES serves, for example during the printing of brochures with a large number of print pages consisting of the same paper, for stacking these print pages consisting of the same paper and then for adding to the stack, for example consisting of 50 pages of the same paper, a draw sheet consisting of another paper grade which was then printed in another job.

The printing assembly DRA can process continuous paper with and without marginal perforations. For this purpose, it contains a friction drive which is described in more detail with regard to FIG. 2.

The job organization control unit JS has essentially a store organization function. It stores, depending on an index, which paper is used or which information has to be printed on which paper. This information is stored in a job-dependent manner according to paper weight and job component, in such a way that it can be retrieved again. This information, programmed by the operator or user, must be entered online or offline in the way described. If, for example, an insurance policy is composed by way of example of a triple job, that is to say from an invoice, a personal letter and an insurance policy, all three single sheets consisting of a different paper, then, by means of the present document printing appliance, for example first the insurance policy is printed in a very large quantity on a separate paper grade and is deposited in the part store T1 of the buffer store ZS. The job organization control unit JS stores the printed job, but does not yet acknowledge it. Next, the invoice is printed on a different paper, for example drawn off from the smaller reels, specifically in a correspondingly large quantity, and is deposited in the depository T2 of the buffer store ZS, and this job is stored and likewise not yet acknowledged. The printout of, for example, the personal letter is subsequently carried out, this job then being deposited in the part store T3 of the buffer store ZS. The personalized letters are then combined as an individual document via the job finishing device JF and, for example, are enveloped in a corresponding enveloping device and dispatched. If advertising prospectuses are also now to be inserted in these personalized letters, these advertising prospectuses can be supplied via the external loading device EB.

Figure 2:
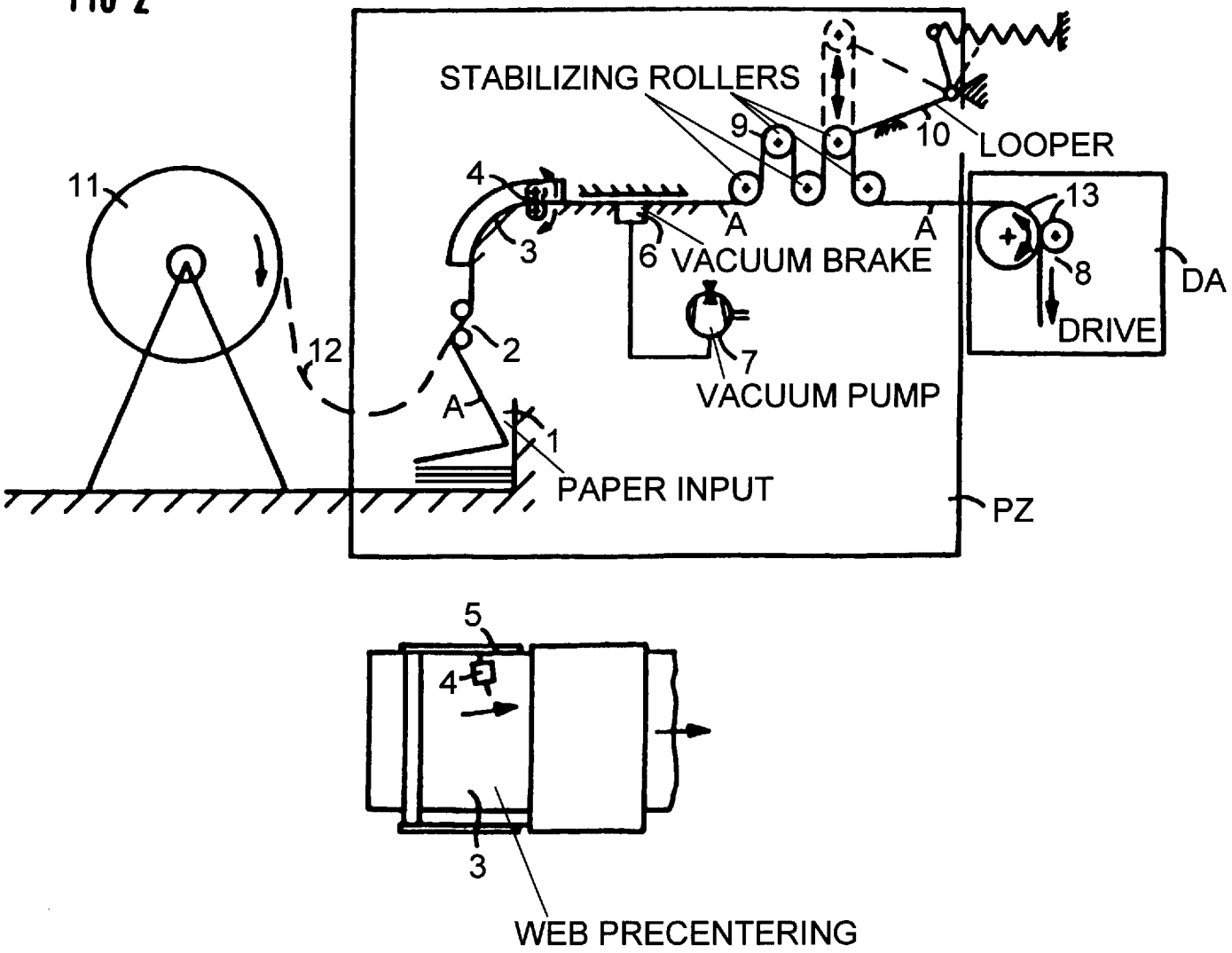
FIG. 2 shows a diagrammatic representation of the paper feed region of the electrographic printing device.
Figure 3:
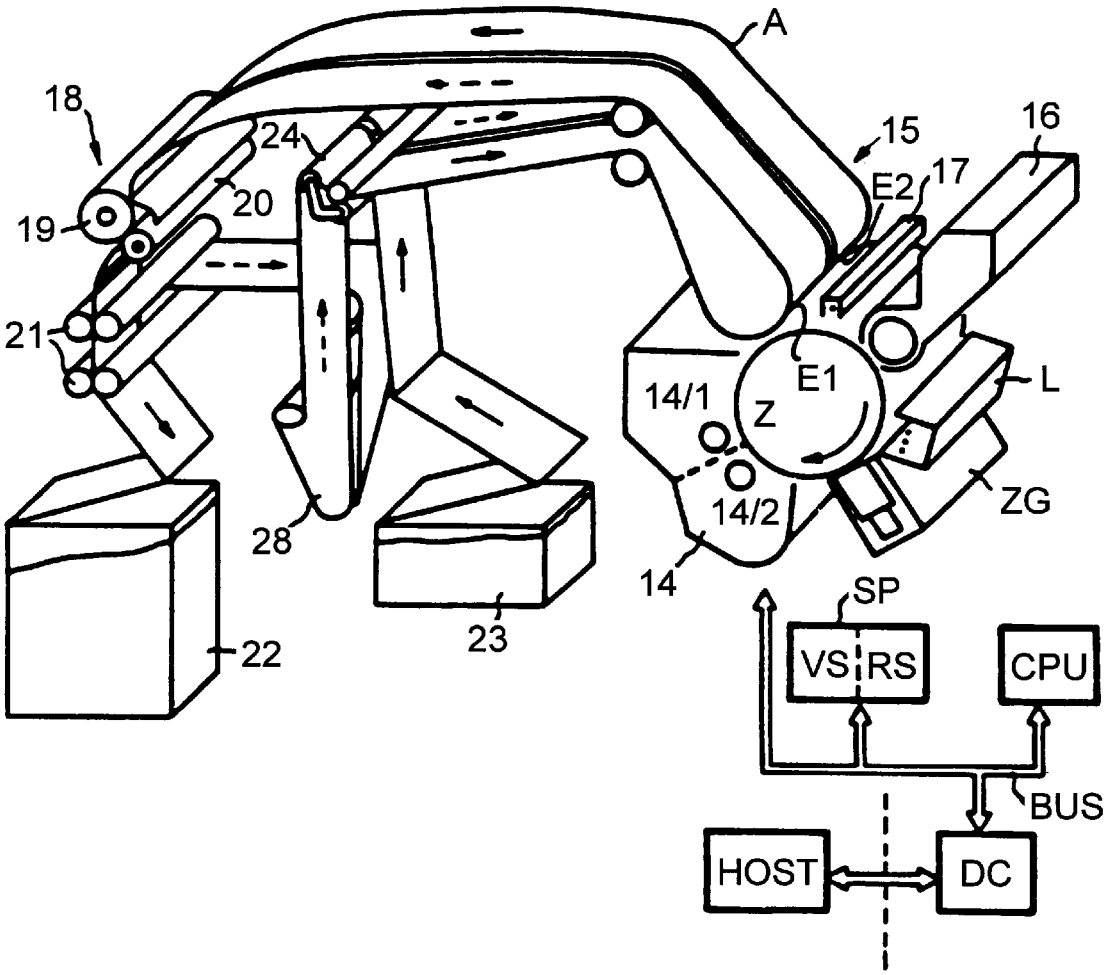
FIG. 3 shows a diagrammatic representation of an electrographic printing device for the printing of strip-like recording media in the duplex mode.
Figure 4:
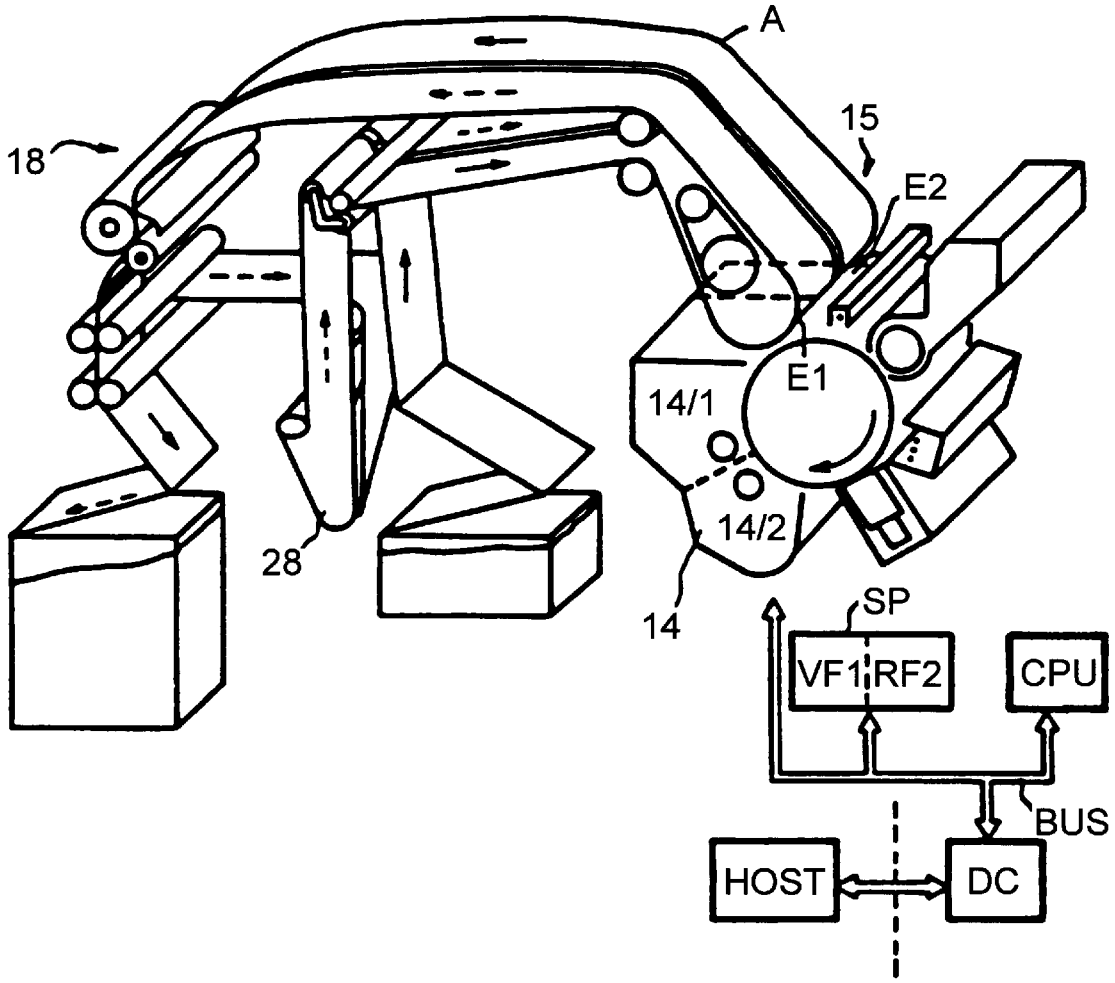
FIG. 4 shows a diagrammatic representation of the same electrographic printing device in the two-color duplex mode.
Figure 5:
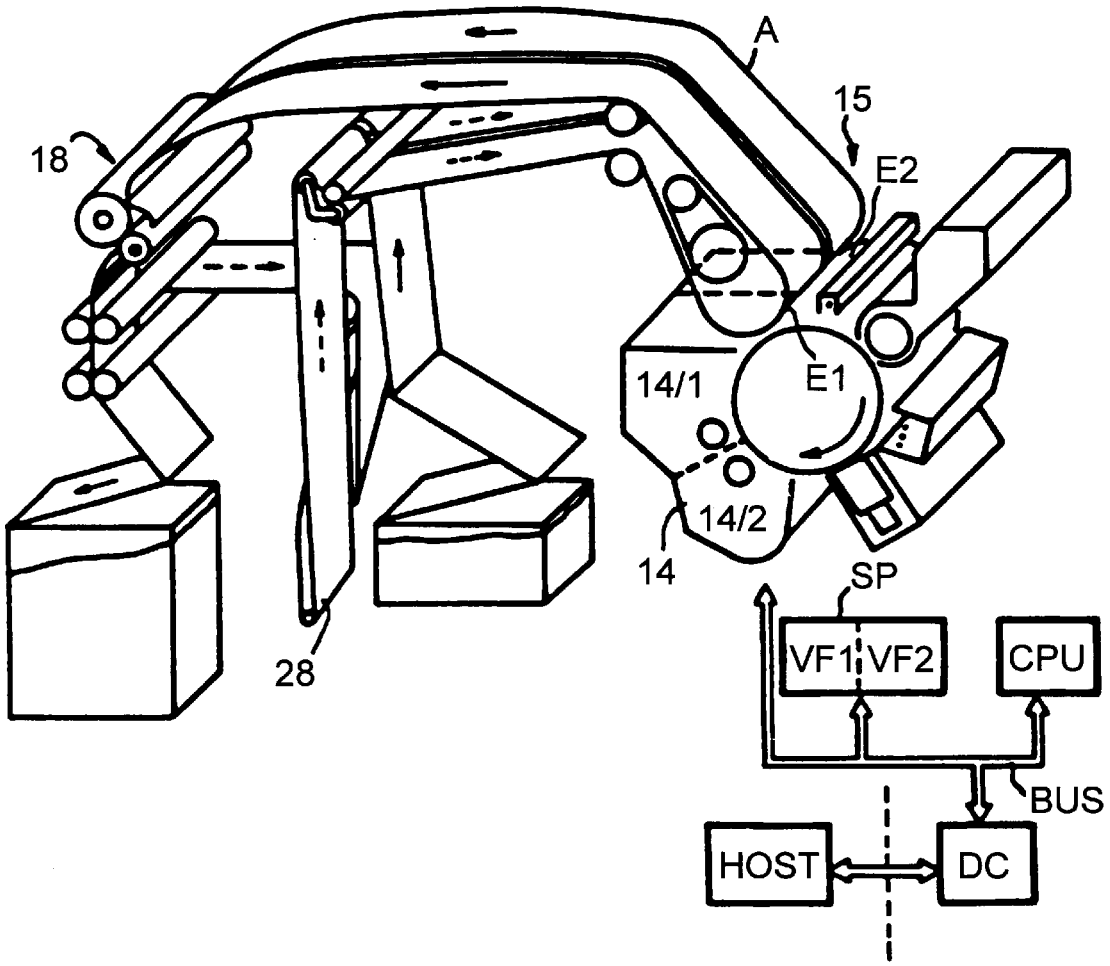
FIG. 5 shows a diagrammatic representation of the same electrographic printing device in the two-color simplex mode.

The printing appliance, represented in FIG. 2, with a friction drive for the processing of strip-like recording media A has an actual printing assembly DA, which can, for example, be designed according to FIGS. 3–9, and a paper feed device PZ. The two together form the printing assembly DRA of FIG. 1.

The printing assembly DA is designed for the processing of web stock or of strip-like recording media A configured as stacking stock. It has a friction drive 8 consisting of two frictional rollers 13, between which the recording medium A is guided through. The strip-like recording medium A is fed via a paper feed device PZ, specifically in the following way. In a paper input device 1, the continuous paper, which is manufactured as prefolded accordion folded paper, but has no lateral feed holes, is first deflected or braked without appreciable web tension via two stationary shafts 2 (a paper divider). The stationary shafts 2 work both as a light brake and as a paper divider, for example in order to separate taken-up web layers from one another. In a web precentering device 3, the paper web is deflected (approximately 90°) and is pushed against a left web limitation 5 in the form of a stop by means of two inclined friction rollers 4 (see FIG. 2) which are in frictional contact with the recording medium A. The position of the paper web or of the recording medium A is thus determined by the bearing of the web edge against the left web limitation of the paper channel of the paper feed device. It is also possible, however, to use the right web limiting as a result of an appropriate arrangement of the rollers 4.

After web precentering step via the web precentering device of FIG. 2, the tensile stress in the paper web A is increased by means of a web brake. In this case, it is important for the paper web A to be braked only in the direction of transport and not obliquely or asymmetrically. This can take place, for example, by means of a vacuum brake 6 with an associated vacuum pump 7. As a result of the tensile stress, the paper web A comes into alignment in drive 8 and endeavors to assume a middle position. The drive of the paper guide 8 is designed as a friction drive with as little slip as possible or a constant coefficient of friction for life, and for this purpose it contains two friction rollers 13, between which the recording medium is guided.

The higher the tensile stress, the smaller the lateral pendulum movements of the web A, and vice versa. This relation also applies to the planeness of the paper web A.

Deflecting rollers 9 arranged downstream of the vacuum brake 6 form a stabilizing zone, in which the paper run of the paper web A is stabilized. Drive-side drift influences on the paper web or on the bearing of the paper web against the web limitation 5 in the web precentering device 3 are thereby greatly reduced. Reaction of the stabilizing rollers 9 is particularly effective when wrap around is as great as possible (in other words large contact surfaces are provided) and with friction linings on the rollers.

A mechanical web store in the form of a looper 10 is arranged in the stabilizing zone, with two stationary rollers and one dancing roller which is moved counter to a spring. The looper holds the paper web A under tension during the reverse transport caused by start/stop. It prevents the recording medium from being torn. In this case, the tensile stress in the paper web A is somewhat below the tension which is otherwise customary and is approximately constant over the entire working region of the looper as far as the stop. After passing through the looper, the paper web A is fed to the friction drive 8 of the printing assembly DA.

When the printing device is operated with web paper which is drawn off from a reel 11, it is beneficial to drive and brake the reel 11 separately, as represented. The drive of the reel 11 or its brake is controlled in such a way that a specific loop 12 serving as a mechanical paper store forms between the reel 11 and paper input 1. The draw into the web precentering device 3 therefore takes place under conditions similar to those in the operation of continuous paper stacks in the paper input 1.

In conclusion, the continuous paper guide can be subdivided functionally into the following steps: paper input by reel or stacks with subsequent web precentering by the lateral bearing of the paper in a web precentering device; increase in the tensile stress by means of a web brake; stabilization of the recording medium web in a web stabilizing device with directed reaction; passage through a looper, in order to prevent the recording medium web from tearing in the start/stop mode, and transport of the recording medium web through the printing device in a friction drive.

The electrographic printing assembly DRA of the document printing device is suitable for the printing of strip-like recording media A of varying web width and can be designed, for example, according to FIGS. 3–9. It contains an electromotively driven photoconductor drum as an intermediate carrier Z. Instead of the photoconductor drum, however, a strip-like intermediate carrier, for example an OPC strip, can also be used, or a magneto-styli arrangement, for magneto-optic printing, such as is described, for example, in EP-B1-0,191,521. Grouped around the intermediate carrier Z are the various assemblies for the electrophotographic process. These are essentially: a charging device L in the form of a charging corotron for charging the intermediate carrier Z; a character generator ZG with a lightemitting diode array for the character-dependent exposure of the intermediate carrier Z, the array extending over the entire useful width of the intermediate carrier Z; a developer station 14 for coloring the character-dependent charge image on the intermediate carrier Z by means of a one-component or two-component developer mixture; a transfer station 15 which extends over the width of the intermediate carrier Z and by means of which the toner images are transferred onto the recording medium A. To remove the residual toner after development and transfer, a cleaning station 16 is provided with a cleaning brush integrated therein and having an associated suction-extraction device and a discharge device 17. The intermediate carrier 11 is driven electromotively and, in the printing mode, is moved in the direction of the arrow.

Furthermore, the printing device contains a fixing station 18 which is located downstream of the transfer station 15 in the direction of transport of the recording medium and which is designed as a thermoprinting fixing station, with a heated fixing roller 19 having an associated pressure roller 20 and with guide rollers 21 which are located downstream of the fixing station and which serve inter alia as output elements for a stacking device 22 for the recording medium A. Instead of the fixing station represented here other fixing stations, for example with a heated or unheated entry saddle, or a cold-fixing station are also possible. The strip-like recording medium A is manufactured, for example, as a prefolded continuous paper provided with marginal perforations and, proceeding from a stock region 23, is fed to the transfer station via feed rollers 24. It is also possible, however, to feed a recording medium without marginal perforations via a roller feed corresponding to the friction drive 8 of FIG. 29.

In the exemplary embodiment represented, the transport of the recording medium takes place by friction via a friction drive corresponding to FIG. 29, which is controlled via a control arrangement which senses synchronization marks. Furthermore, arranged in the housing region of the printing device, between the stock region 23 and the fixing station 18, is a deflecting device 28, the function of which is explained later and via which the recording medium is returned from the fixing station 18 to the transfer station 15.

The printing device is controlled via a printer control which is represented diagrammatically here, with a central unit CPU, a page store SP, which is subdivided into storage regions in a page-dependent manner, and a data control unit DC. All the units of the control are connected to one another and to the assemblies of the printing device via a BUS system.

The electrographic printing device is suitable for the printing of recording media having a differing web width. For this purpose, the intermediate carrier Z (which here is a photoconductor drum) has a useful width which corresponds to the largest possible recording medium width (for example, a DIN A3 format crosswise). This width corresponds to double the DIN A4 web width. It is thus possible to arrange two DIN A4 recording medium widths lengthwise next to one another in the region of the transfer station 15. The fixing station 18 and the other electrophotographic assemblies, such as the developer station 14, character generator ZG and cleaning station 16, are designed according to this useful width.

An adaptation of the width of the character generator ZG to different recording medium widths does not require any mechanical change on the character generator when, as in this case, an LED character generator is used, with a multiplicity of LEDs arranged in rows. Adaptation to the recording medium width used is carried out electronically by triggering.

The deflecting device 28 arranged in a return duct for narrow recording media from the fixing station to the transfer station has two functions: it serves in the continuous-pass mode (FIG. 8) for the lateral offset of the recording medium web and in the turning mode (FIG. 9) for recto/verso turning of the recording medium. It is designed reversibly in dependence on the operating mode. Three deflecting elements 29/1, 29/2 and 29/3 designed as rollers or deflecting rods with a smooth wear-resistant surface serve for the vertical deflection of the recording medium. With an appropriate arrangement of the deflecting device in the printing device according to the exemplary embodiments of FIGS. 3 to 5, the function of the deflecting element 29/2 can be performed by the feed rollers 24. Furthermore, the deflecting device contains a deflecting contour consisting of two deflecting rods 30/1 and 30/2 which, in the exemplary embodiment represented, are arranged inclined at 45° to the direction of transport of the recording medium. The deflecting rod 30/2 which is second, as seen in the direction of transport of the recording medium, is arranged so as to be capable of being pivoted round via a mechanism not shown here and specifically out of a position parallel to the first deflecting rod 30/1 into a position perpendicular thereto. The deflecting rods 30/1 and 30/2 should not be designed as rotating rollers, since the recording medium would run away laterally in the rolling movement. They are designed as a stationary roller or as a corresponding molding. Since the recording medium, usually consisting of paper, brushes over the surface, it is advantageous to select a smooth and wear-resistant coating and/or to blow air through orifices, which can be located in the contact surface, and thereby build up an air cushion. The horizontal deflecting elements 29/1 to 29/3 can be designed as rotatable rollers or, according to the deflecting contour, as stationary deflecting rods, if appropriate with air outlet orifices.

Figure 8:
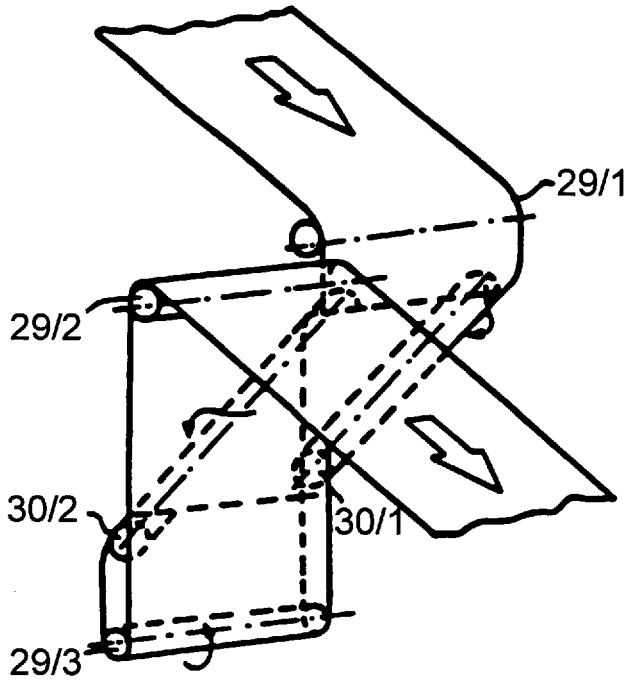
FIG. 8 shows a diagrammatic representation of a deflecting device arranged in the electrographic printing device, in the continuous-pass mode (simplex printing)

In the continuous-pass mode represented in FIG. 8, the recording medium returned from the fixing station 18 is first deflected downwards via the deflecting roller 29/1 and is then guided around the deflecting rod 30/1 in the direction of the arrow and thus deflected horizontally. Renewed deflection around the deflecting rod 30/2 downwards in the vertical direction subsequently takes place. After renewed deflection by the horizontal deflecting roller 29/3, a feed of the recording medium offset in width to the deflecting element 29/2 or to the feed rollers 24 takes place.

Figure 9:
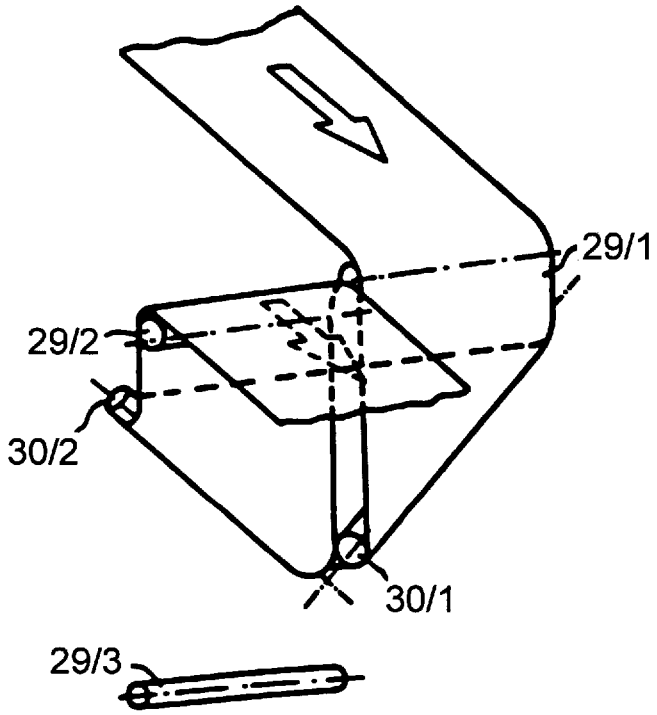
FIG. 9 shows a diagrammatic representation of the same deflecting device in the turning mode (duplex printing).

In the turning position of the deflecting device, as represented in FIG. 9, the recording medium is turned through 180° in the manner shown. In this case, the recording medium is first deflected downwards via the horizontal deflecting roller 29/1, guided around the first oblique deflecting rod 30/1 from front to rear and thus deflected horizontally. Renewed deflection around the second oblique deflecting rod 30/2 takes place thereafter, with a subsequent feed to the horizontal deflecting element 29/2 or to the feed rollers 24.

Function of the electrographic printing device in different operating modes

Simplex mode

The printing device according to the invention allows the most diverse operating modes without a change in the hardware design. For the one-sided printing of a wide recording medium according to the representation of FIG. 6, the recording medium, proceeding from the stock region 23 (stock stack), is guided conventionally via the feed rollers 24 to the transfer station 15, provided with toner images there and fixed in the fixing station 18 and subsequently deposited in the stacking device 22. Transport takes place, in this case, via the transport device 25 which engages in the margin perforations of the recording medium, the width of the transport device 25 being set according to the width of the recording medium.

A recording medium of such width makes it possible, for example, to print with DIN A3 toner images arranged crosswise or else with two DIN A4 toner images arranged next to one another.

Figure 7:
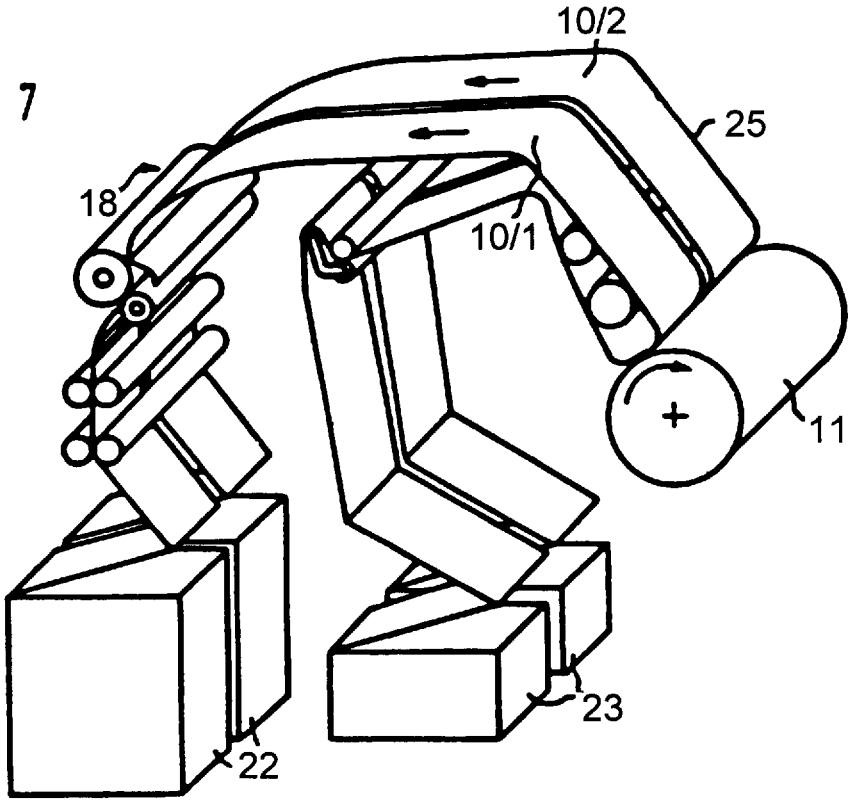
FIG. 7 shows a diagrammatic representation of the same electrographic printing device in the simplex mode for the simultaneous printing of two strip-like recording media.

To print two narrow recording media, for example having a width DIN A4, arranged next to one another, the two recording medium webs 10/1, 10/2 are guided in parallel through the printing device in accordance with the illustration in FIG. 7.

Single-color duplex mode

For the single-color printing of a narrow recording medium on both sides in the duplex mode, as represented in FIG. 3, the narrow recording medium, for example having a width DIN A4, proceeding from the stock region 23, is fed to the transfer station 15 via the feed rollers 24 and is printed on its surface with a recto toner image. In this case, the recto of the recording medium A is identified by unbroken transport arrows and the verso by broken transport arrows. The recording medium having the recto toner image is subsequently fed to the fixing station 18 and the recto toner image is fixed. Via the guide rollers 21, further transport of the recording medium takes place to the deflecting device 28, whose deflecting contour is put into a turning position. In the deflecting device 28, the recording medium is turned in respect of its recto and verso and is once again fed to the transfer device via the feed rollers 24 in such a way that its verso can be provided with a verso toner image. Thereafter, the recording medium is once more fed to the fixing station 18 and the verso toner image is fixed and subsequently the recording medium printed on both sides is deposited in the stacking device 22.

Since the recto and the verso toner images are produced and transferred onto the recording medium at different moments, a corresponding data processing via the printer control is necessary. For this purpose, the page store SP contains storage regions VS for storing the recto image data and storage regions RS for storing the verso image data. Data processing takes place, in this case, via the data control device DC, the data, coming from a data source (HOST), which is for example an external data store, being fed to the data control device DC via an interface. The data of the individual pages to be printed are deposited in the page store SP, in particular separately according to recto VS and verso.

RS in the corresponding storage regions. The retrieval of the data then takes place by time control, so that the desired recto/verso allocation of the toner images is achieved on the recording medium.

Two-color duplex mode

The printing device is also suitable for operation in the multicolor printing mode. For this purpose, according to the representation of FIG. 4, the developer station 14 can be designed in such a way that it produces separately colorable developer zones E1 and E2 on the intermediate carrier Z. In this case, each position region of the narrow recording media is assigned a corresponding developer zone E1 or E2 on the intermediate carrier Z during passage through the transfer station 15. To produce these separately colorable developer zones E1 and E2 the developer zones can be assigned in each case to two developer stations 14/1 and 14/2 arranged in series. In this case, the developer station 14/1 contains a toner mixture of a first color, for example red, and the developer station 14/2 contains a developer mixture in a second color, for example black. The developer stations 14/1 and 14/2 are designed so as to be separately activatable in respect of the developer zones E1 and E2, specifically either by means of mechanical flaps or the like or by electric activation of the developer rollers. Each of the developer stations 14/1 and 14/2 can extend over the entire width of the intermediate carrier 11, but it must be ensured that they can be separately activated individually in respect of the developer zones E1 and E2. It is also possible, however, to design each of the developer stations 14/1 and 14/2 as two developer stations arranged separately next to another.

So that, according to the representation of FIG. 4, a narrow recording medium can be printed with different colors on both sides, the recording medium is guided through the printing device in the same manner as in FIG. 3. In a first pass through the transfer station 15, the application of a recto image in a first color, for example red, is carried out via the developer station 14/1 in the developer zone E2. In a second pass through the transfer station 15, after the turning operation via the deflecting device 28, a verso toner image in a second color, for example black, is applied in the developer zone E1 via the developer station 14/2. The control of the application of the toner image takes place according to the exemplary embodiment of FIG. 3 via the printer control, the image data for the recto toner image of color 1 (red) being deposited in the storage region VF 1 of the page store SP and the image data for the verso toner image of color 2 (black) being deposited in the storage region RF2.

It should be noted that the separate developer stations 14/1, 14/2 can also be used for the single-color printing of the recording medium on both sides in the duplex mode according to FIG. 3. In this case, only one of the developer stations 14/1 or 14/2 is activated, depending on the desired color.

Two-color simplex mode

Figure 6:
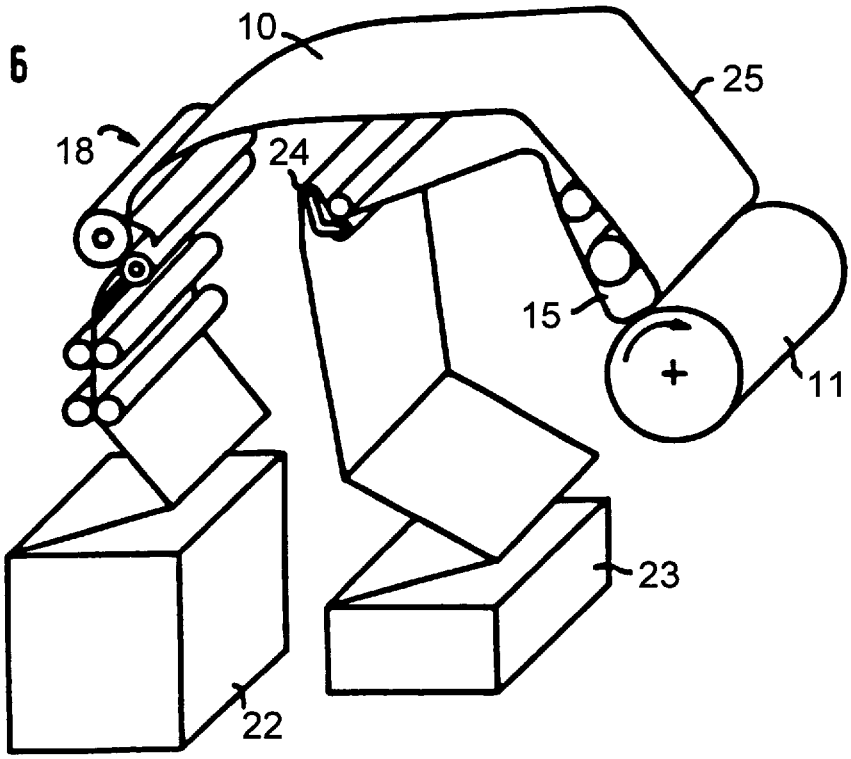
FIG. 6 shows a diagrammatic representation of the same electrographic printing device in the simplex mode for the printing of a wide strip-like recording medium.

As represented in FIG. 5, it is possible with the printing device to print a narrow recording medium of, for example, A4 width on one side with two colors. For this purpose, the developer station can be designed in the manner described with regard to FIG. 3. In this case, each recording medium position at the transfer station is assigned a separately colorable developer zone E1 and E2. In a first pass through the transfer station 15, the printing of a toner image takes place via the developer zone E2 in a first color, for example red. Subsequently, the toner image of this first color is fixed in the fixing station 18 and the recording medium is once again fed, without being turned, to the transfer station 15 having the associated developer zone E1. In this case the deflecting device 28 is in an operating state as represented in FIG. 6, that is to say it is in continuous-pass position, and offset the recording medium is offset purely in width, with the relative allocation of recto and verso being maintained. During the second pass through the transfer station, the first fixed toner image having the first color (red) has superposed on it a second toner image having the second color (for example black), and a two-color overall image is thus produced. The superposed toner image is then fixed once again in the fixing station 18, and the recording medium printed on one side is deposited in the stacking device 22.

It is also possible, instead of superposing toner images, to arrange differently colored toner images on the recording medium in a manner offset relative to one another.

As in the exemplary embodiments of FIGS. 3 and 4, the control of the application of the toner image takes place via the printer control. In this case, the storage region VF1 of the page store SP contains the image data of a recto image of color 1 (red) and the storage region VF2 of the page store SP contains the image data of a recto color image of color 2 (black). The retrieval of the image data and the control of the developer station 14 take place via the data control device DC in the manner described.

Although other modifications and changes may be suggested by those skilled in the art, it is the intention of the inventors to embody within the patent warranted hereon all changes and modifications as reasonably and properly come within the scope of their contribution to the art.

I claim:

1. A document printing apparatus, comprising:

a paper feed device operable for processing strip-like recording media of preselectable configuration, an electrographic printing device having an input which is coupled to said paper feed device and which has means for printing the strip-like recording medium on at least one side, said electrographic printing device having an output, a paper post-processing device coupled to said output of said electrographic printing device and having;

a print-page separating device, and a buffer store for job-related reception of separated print pages in corresponding storage regions from said print-page separating device, and a job finishing device coupled to said buffer store and which extracts from said corresponding storage regions of said buffer store in a document-dependent manner a first job component of a first paper grade, which, drawn off from a first recording medium web, has been deposited in a first of said corresponding storage regions of said buffer store, and a second job component of a second paper grade, which, drawn off from a second recording medium web, has been deposited in a second of said corresponding storage regions of said buffer store, and which combines said first job component and said second job component to form a document, and a job organization control unit connected to control said electrographic printing device and said job finishing device in dependence on an enterable document makeup.

2. A document printing apparatus as claimed in claim 1, wherein said job organization control unit comprises:

input means for input of the enterable document makeup, and a selection control coupled to said input means and said paper feed device and said electrographic printing device and said job finishing device of said document printing apparatus, in order, depending on said enterable document makeup, to print said strip-like recording media via said printing device in a configuration-related manner, separate them in said separating device, deposit them in said buffer store and combine them in said job finishing device according to said desired document makeup to form a document.

3. A document printing apparatus as claimed in claim 1, wherein said job organization control unit includes: means for recording a quantity of said print pages processed in said printer and a quantity of said separated sheets deposited in said buffer store, and a comparison device which triggers an evaluation signal in dependence on a comparison operation of said means for recording.

4. A document printing apparatus as claimed in claim 1, wherein said paper feed device includes means for receiving different stock rolls of said strip-like recording media.

5. A document printing apparatus as claimed in claim 1 wherein said print-page separating device includes a cutting device having an associated waste disposal device.

6. A document printing apparatus as claimed in claim 1, wherein said buffer store has part stores assigned to individual printing jobs.

7. A document printing apparatus as claimed in claim 1, further comprising: a binding device coupled to said job finishing device and which compiles documents.

8. A document printing apparatus as claimed in claim 1, wherein said electrographic printing device has a friction drive engaging said strip-like recording medium for movement through said electrographic printer device.

9. A document printing apparatus as claimed in claim 8, wherein said paper feed device has:

a web precentering device which aligns said strip-like recording medium by positive guidance along an alignment edge, a means for increasing tensile stress in a strip-like recording medium downstream of said web centering device in a direction of transport of said recording medium, such that said strip-like recording medium assumes a predetermined position in said friction drive, a web stabilizing device stabilizing a run of said recording medium in a stabilizing zone preceding said friction drive, and a mechanical web store for said recording medium web.

10. A document printing apparatus as claimed in claim 9, wherein said web precentering device has friction rollers which are inclined relative to said direction of transport of said recording medium and which are in frictional contact with said recording medium.

11. A document printing apparatus as claimed in claim 9, wherein said means for increasing the tensile stress has a braking device which uniformly brakes said recording medium web over its width.

12. A document printing apparatus as claimed in claim 9, wherein said web stabilizing device has stabilizing rollers round which said recording medium is wrapped and which are provided with a friction-increasing surface.

13. A document printing apparatus as claimed in claim 9, wherein said mechanical web store has a looper.

14. A document printing apparatus as claimed in claim 1, further comprising:

a single-sheet loading device assigned to said buffer store, for external loading of said buffer store with prefabricated single sheets.

15. A method for producing a document composed of single sheets of a first paper grade and a second paper grade, comprising the following method steps:

printing of a first strip-like recording medium assigned to the first paper grade and printing of a second strip-like recording medium assigned to the second paper grade in an electrographic printing device which is suitable for printing said recording media on at least one side;

separation of said strip-like recording media and paper grade-related depositing of the single sheets thus produced in part stores of a buffer store; and controlled compilation of job component of said first strip-like recording medium and of a job component of the second strip-like recording medium to form a document.

16. A document printing apparatus as claimed in claim 1, wherein said paper feed device includes means for receiving different stacks of said strip-like recording media.

17. A document printing apparatus as claimed in claim 1, further comprising:

a stitching device coupled to said job finishing device and which compiles documents.

* * * * *